US005299341A

United States Patent [19]

Wakao

[11] Patent Number: 5,299,341

[45] Date of Patent: Apr. 5, 1994

[54] ROTATING KEYBOARD CLEANER

[76] Inventor: Hiroshi Wakao, 3-151 Onada Cho, Tajimi-shi, Gifu-ken, Japan, 507

[21] Appl. No.: 991,863

[22] Filed: Dec. 15, 1992

[51] Int. Cl.[5] ..... A47L 25/00

[52] U.S. Cl. ..... 15/210.1; 15/184; 15/244.1; 206/362; 401/57; 401/90

[58] Field of Search ..... 15/118, 168, 169, 184, 15/194, 202, 209.1, 210.1, 244.1; 206/361, 362, 537; 401/29, 34, 57, 90

[56] References Cited

U.S. PATENT DOCUMENTS

| | | | |
|---|---|---|---|
| 940,797 | 11/1909 | Fraser | 15/184 |
| 1,080,633 | 12/1913 | Husch et al. | 15/194 |
| 1,451,775 | 4/1923 | Husch et al. | 15/194 |
| 2,753,582 | 7/1956 | Fredericks | 15/244.1 |
| 4,346,495 | 8/1982 | Lin | 15/184 |
| 4,854,761 | 8/1989 | Smith et al. | 401/57 |

FOREIGN PATENT DOCUMENTS

| | | | |
|---|---|---|---|
| 2210931 | 9/1973 | Fed. Rep. of Germany | 401/57 |

*Primary Examiner*—Harvey C. Hornsby
*Assistant Examiner*—Mark Spisich

[57] ABSTRACT

A rotating keyboard cleaner includes a container having openings at the top and at the bottom, and a removable cap that fits frictionally over the top opening. Inside the container is a plurality of units, each unit including a capsule with a cleaning head member fixedly joined to and projecting from the capsule. These units fit frictionally atop one another in a nesting relationship inside the container with the cleaning head member of one unit being received within a hollow opening in another unit.

7 Claims, 2 Drawing Sheets

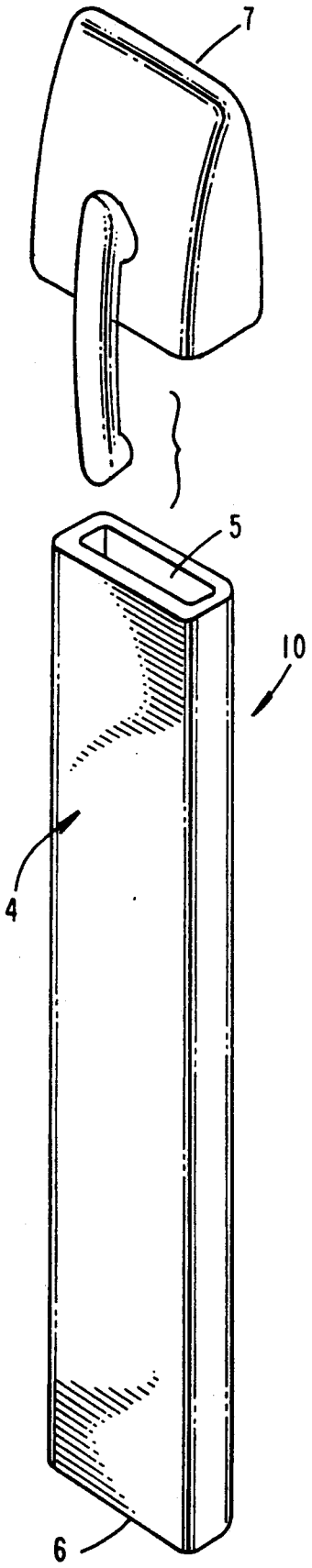
FIG. 1
FIG. 2
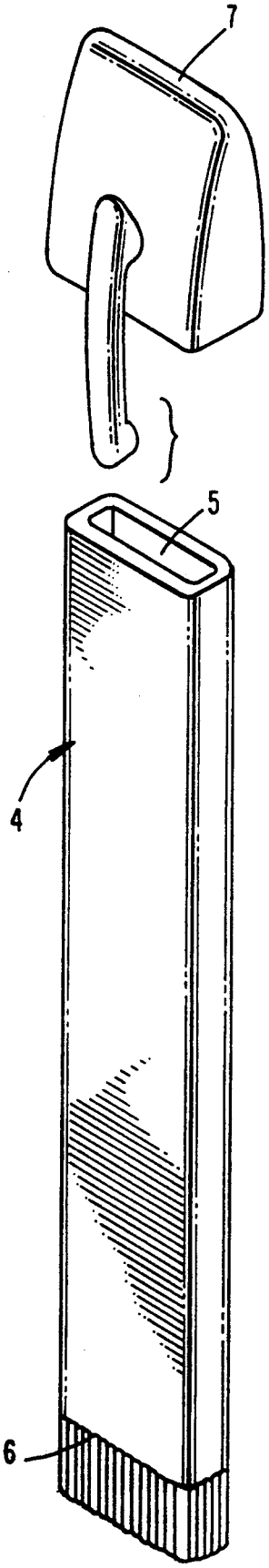
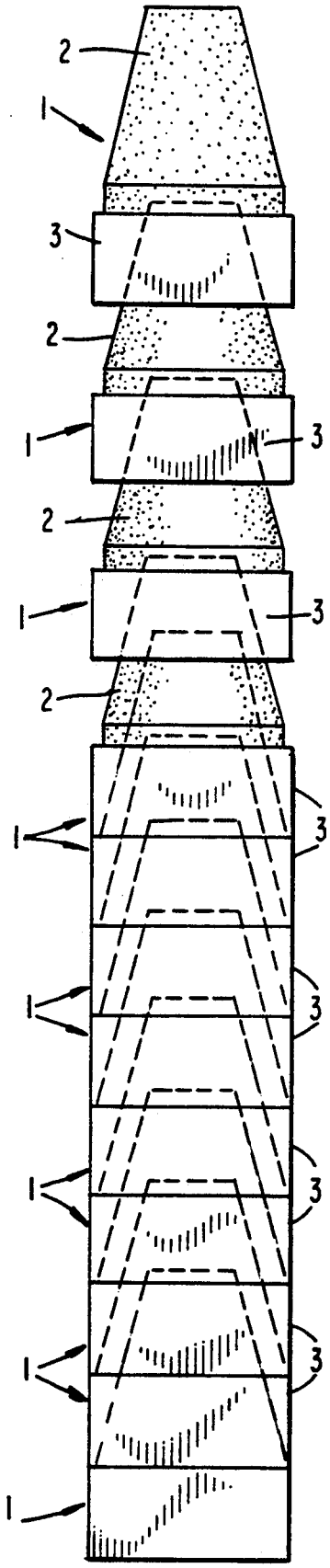
FIG. 3

ROTATING KEYBOARD CLEANER

This invention relates to a rotating keyboard cleaner. This rotating keyboard cleaner is used for cleaning computer and typewriter keyboards effectively and speedily.

At present, computer and typewriter keyboards are cleaned with a cloth dipped in a cleaner, or with a cloth-covered sharp object. With these products, all keys may not be evenly cleaned. Also, sensitive keys require more delicate care than these products permit. With these products, keyboard cleaning is time consuming, and does not provide complete access to all narrow, fine edges, or to the sensitive parts of the computer and typewriter keyboards.

The rotating keyboard cleaner of this invention provides complete access to all narrow and hidden parts of computer and typewriter keyboards. In preferred embodiments, the cleaning head includes a soft fine edge to provide effective cleaning action without damage to computer and typewriter keyboards. This cleaner can also be used to clean narrow edges and hard-to-reach spots in other kinds of office equipment.

BRIEF DESCRIPTION OF THE DRAWINGS

The rotating keyboard cleaner of this invention can better be understood by reference to the drawings, in which:

FIG. 1 is a perspective view of an embodiment of the container, and container top, for an embodiment of the rotating keyboard cleaner of this invention;

FIG. 2 is a side elevation view, partially exploded, of a plurality of interfitting keyboard cleaners that ar received in the container shown in FIG. 1;

FIG. 3 is a side elevation view, partially exploded, of the keyboard cleaners shown in FIG. 2;

BRIEF DESCRIPTION OF THE PREFERRED EMBODIMENT

Figure 4:
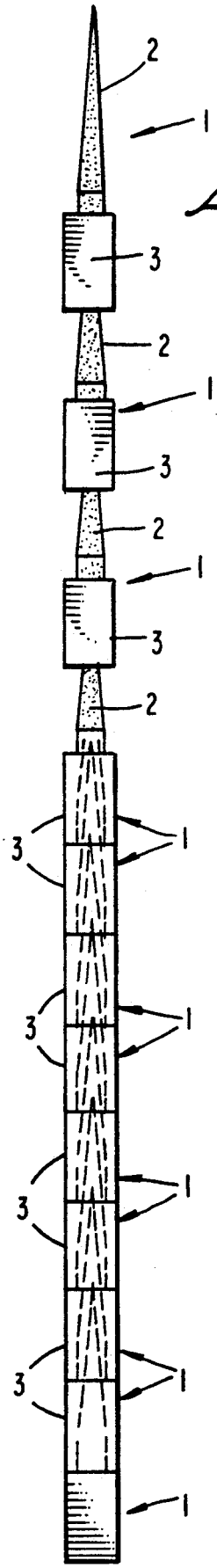
FIG. 4 is an end view of one of the keyboard cleaners shown in FIG. 2.

FIGS. 1–6 show an embodiment of the keyboard cleaner of this invention. Cleaner 10 comprises a number of cleaning heads 2, each individually fixed to capsule 3. Cleaning head 2 with capsule 3 attached constitutes unit 1. These units 1 are stacked, in a nesting relationship, one above the other in a handy narrow container 4. Container 4 includes top opening 5 exposing cleaning head 2 for use. Top opening 5 has includes cap 7 which covers opening 5 and cleaning heads 2. Container 4 has a rear opening 6 for insertion of units 1. Used units 1 can be removed from barrel 4 at opening 5.

To use cleaner 10, the user removes cap 7, exposing topmost cleaning head 2 from at opening 5. Once cleaning head 2 becomes dirty through use, the user can remove topmost unit 1, carrying used cleaning head 2 from container 4, and insert this used unit into the rear of container 4. By so doing, the next cleaning head 2 is exposed at opening 5 in the operational position. Each time the user needs a new cleaning head, he will repeat these steps. After all cleaning heads are used, a new set of cleaning heads can be inserted into container 4 through rear opening 6.

Figure 5:
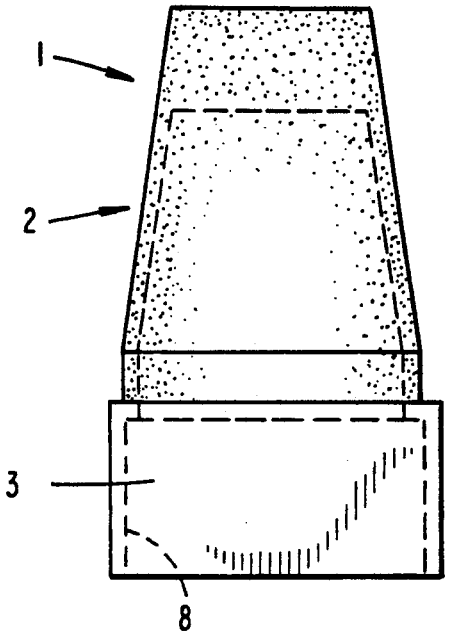
FIG. 5 is a side elevation view of one of the keyboard cleaners shown in FIG. 4.
Figure 6:
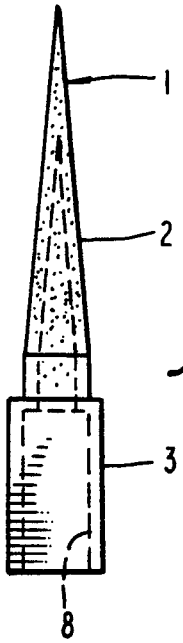
FIG. 6 is an end elevation view of the keyboard cleaner shown in FIGS. 4 and 5.
Figure 7:
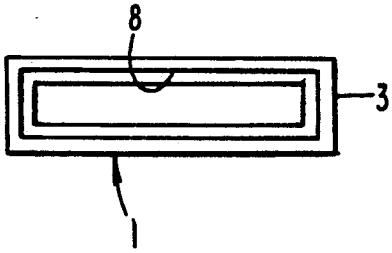
FIG. 7 a bottom view of the keyboard cleaner shown in FIGS. 4–6.

As FIGS. 4, 5 and 6 show, each of the keyboard cleaner units 1 includes capsule member 3 and cleaning head 2, attached to, and preferably embedded in, the upper surface of capsule 3. Capsule 3 and cleaning head 2 have an interior hollow space of a size and shape adapted to receive and enclose a cleaning head 2 projecting from capsule 3 of a second unit, as FIGS. 2 and 3 show. Each of cleaning heads 2 is frusto-conical in shape; each of capsules 3 is quadrilateral-shaped. Each unit is nested atop another unit by passing cleaning head 2 of a first unit 1 through opening 7 at the bottom of a second unit 1, and pushing the two units together until the cleaning head 2 of the first capsule 3 is entirely enclosed inside capsule 3 and cleaning head 2 of a second unit 1, as FIGS. 2 and 3 show.

What is claimed is:

1. A keyboard cleaner comprising a container having a first end, a second end and a top opening at said first end, and a removable cap for said first end; inside said container, a plurality of units, each unit comprising a hallow capsule, and fixedly joined to each of said capsules, a hollow, tapered cleaning head member having a size and shape sufficient to fit between keys in said keyboard, said units being adapted to fit atop one another in a nesting relationship with the cleaning head member of one unit fitting inside the capsule and inside the hollow, tapered cleaning head member of another adjacent capsule inside said container; at a second end of said container opposite said opening, a bottom opening adapted to receive said units in said nesting relationship, wherein any one capsule is adapted to cover the cleaning head member projecting from any other adjacent capsule when said any other capsule is frictionally fit into said any one capsule.

2. The keyboard cleaner of claim 1 wherein said container is rectangular in shape, each of said capsules has two ends, and is rectangular in shape, and each of said capsules has a transverse member across one of said two ends with said cleaning head member projecting therefrom, each of said capsules and each of said cleaning head members includes a hollow space, said hollow space enclosing said cleaning head member projecting from said any other capsule when said any one capsule is frictionally fit atop said any other capsule.

3. The keyboard cleaner of claim 1 in which each of said capsules includes a top surface, and each of said cleaning head members is fixedly imbedded in each of said top surfaces.

4. The rotating cleaner of claim 1 wherein said container completely encloses each of said units, and where, upon insertion of an additional unit into said container through said bottom opening, each of said units above said bottom opening is pushed toward the top of said container.

5. The rotating cleanser of claim 2 wherein said container completely encloses each of said units, and where, upon insertion of an additional unit into said container through said bottom opening, each of the units above said bottom opening is pushed toward the top of said container.

6. The rotating cleaner of claim 3 wherein said container completely encloses each of said units, and where, upon insertion of an additional unit into said container through said bottom opening, each of the units above said bottom opening is pushed toward the top of said container.

7. A cleaning head-carrying capsule adapted to clean a keyboard comprising:

a four-sided, rectangular-shaped, two-ended member having one end joined to a transverse wall member extending across said one end of said four-sided member, said four-sided member having a hollow, tapered cleaning head member having a size and shape sufficient to fit between keys in said keyboard imbedded in and projecting from said transverse wall member, said four-sided member having a hollow opening at its other end in communication with the hollow in the cleaning head member and of sufficient size and shape beneath said transverse wall member to receive a cleaning head member projecting from a transverse wall member in another, substantially identical cleaning head-carrying capsule when one of said capsules and another of said capsules are frictionally fit together whereby the cleaning head member of one unit is adapted to fit inside the capsule and inside the hollow, tapered cleaning head member of said another capsule.

* * * * *